United States Patent [19]

Leehan

[11] 4,305,584

[45] Dec. 15, 1981

[54] LIFTING AND PROPELLING SLING FOR BOWLING BALLS

[76] Inventor: William J. Leehan, 6001 Arlington Blvd., No. 812, Falls Church, Va. 22044

[21] Appl. No.: 201,749

[22] Filed: Oct. 29, 1980

[51] Int. Cl.[3] ..... A41B 3/00; A63B 43/02

[52] U.S. Cl. ..... 273/64; 294/31.2; 294/152; 124/5; 224/919

[58] Field of Search ..... 273/64, 54 B, 129 R, 273/129 K; 294/31.2, 74, 140, 149, 150, 152, 157, 164, 165; 124/5; 224/919

[56] References Cited

U.S. PATENT DOCUMENTS

| | | | |
|---|---|---|---|
| 1,199,330 | 9/1916 | Adams | 273/64 |
| 2,311,160 | 2/1943 | Dobbelaar | 124/5 |
| 3,281,883 | 11/1966 | Glantz | 273/54 BX |
| 3,918,618 | 11/1975 | Castaneda | 294/74 X |
| 4,022,507 | 5/1977 | Marino | 294/74 |
| 4,131,102 | 12/1978 | Polly | 124/5 |
| 4,220,333 | 9/1980 | Mercer | 294/157 X |

*Primary Examiner*—George J. Marlo
*Attorney, Agent, or Firm*—B. P. Fishburne, Jr.

[57] ABSTRACT

A strong flexible lightweight sling for lifting and propelling a bowling ball avoids the necessity for drilling finger grip openings in the ball and allows any bowler to bowl successfully with any ball. The annular body portion of the sling is adapted to completely surround a bowling ball snugly in a region below the maximum diameter plane of the ball and to have its diameter adjusted for convenient application to the ball and safe lifting and propelling without slippage. Flexible finger grip loops are employed to swing and release the bowling bowl with precision and to accomplish the girth adjustment of the sling body on the ball.

9 Claims, 10 Drawing Figures

FIG. 5
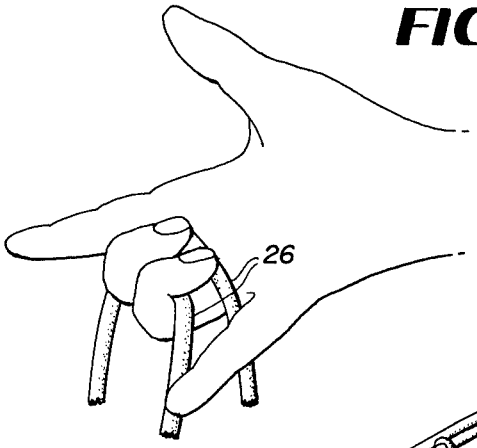
FIG. 6
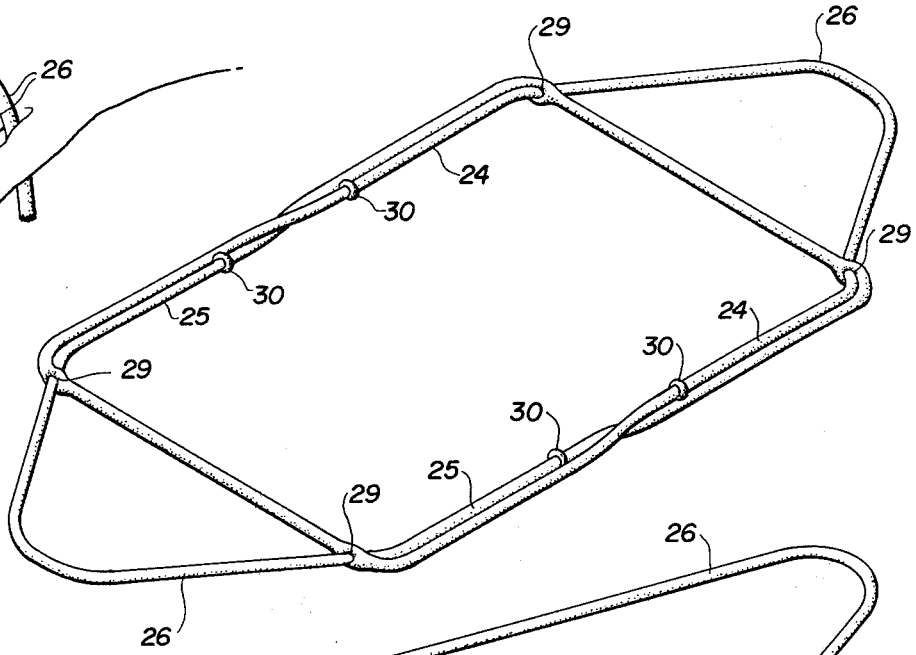
FIG. 7
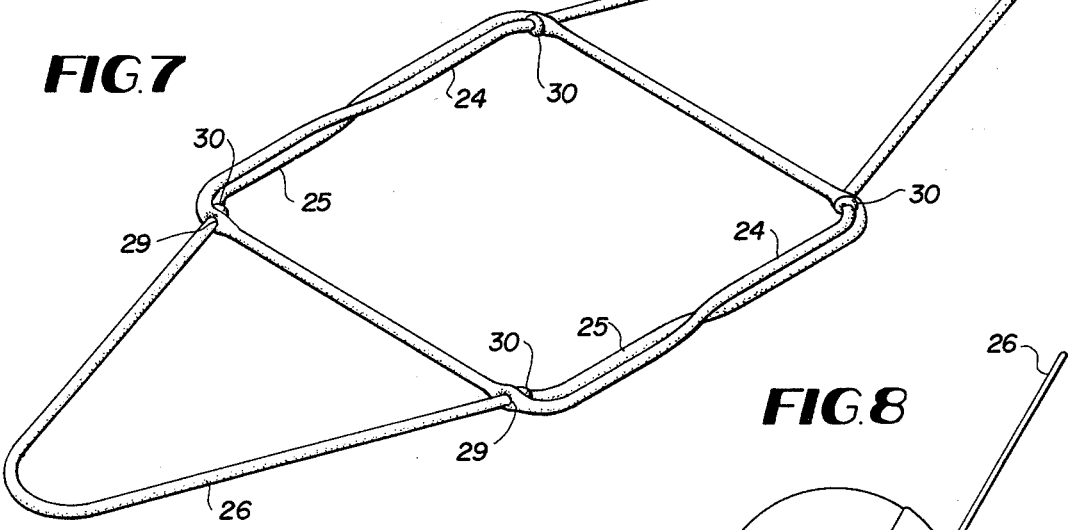
FIG. 8
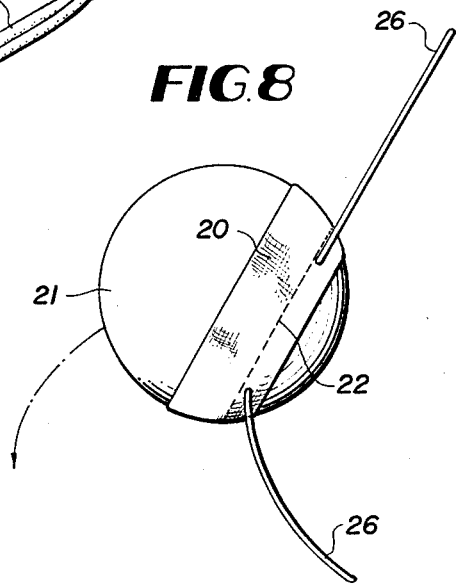
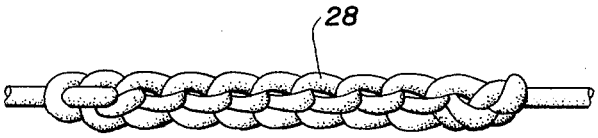
FIG. 9

LIFTING AND PROPELLING SLING FOR BOWLING BALLS

BACKGROUND OF THE INVENTION

The desirability and need for a bowling ball propelling device has been recognized in the prior art. U.S. Pat. No. 1,199,330 issued to Adams shows such a device in the nature of a flexible sling for use in bowling. The main objective of the present invention is to improve on the prior art reflected by the Adams patent through provision of a more simplified, practical and economical sling structure which avoids completely the use of metal or other rigid components and which is completely symmetrical in the sense of being adaptable to any bowling ball and to right and left handed bowlers without necessitating placement of the sling on the ball in a particular position. The sling, in accordance with the invention, is essentially unitary and has no buckles, straps or other mechanical components requiring manipulation or adjustment. The simple girth adjustment of the body portion of the sling is accomplished simply by expanding the body portion with the hands, followed by constricting it after application to the bowling ball by pulling the finger grip loops in opposite directions. This unique simplified adjustment comprises a significant feature of the present invention.

A major benefit gained by the use of the invention is complete elimination of the necessity for drilling customized finger and thumb grip openings in the ball. This customary procedure is not only expensive but causes permanent unbalancing of the ball which acts against precision bowling.

The invention also eliminates blistered and tortured fingers well known to all regular bowlers. Its use enables the bowler to successfully bowl with any "house ball" without regard to correct fit and to bowl with balls having no finger grip openings or including such openings.

A further objective of the invention is to provide an aid to bowling which, after due practice, can actually improve bowling skill and which will allow many individuals to bowl successfully and with pleasure, who presently do not or cannot bowl because of finger arthritis or other infirmities.

Other features and advantages of the invention will become apparent to those skilled in the art during the course of the following detailed description.

BRIEF DESCRIPTION OF THE DRAWINGS

FIG. 5 is a similar view further illustrating the manner of using the sling.

FIGS. 6 and 7 are schematic views showing the girth adjusting means for the sling embodied in the finger grip loops.

FIG. 8 is a schematic elevational view of the sling at the moment of ball release.

FIG. 9 is a fragmentary elevational view showing optional braiding of the finger grip loops for comfort.

DETAILED DESCRIPTION

Figure 10:
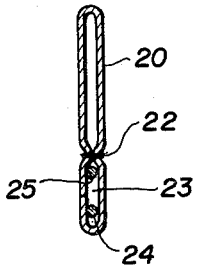
FIG. 10 is a fragmentary vertical section through the sling body taken on line 10—10 of FIG. 2.
Figure 3:
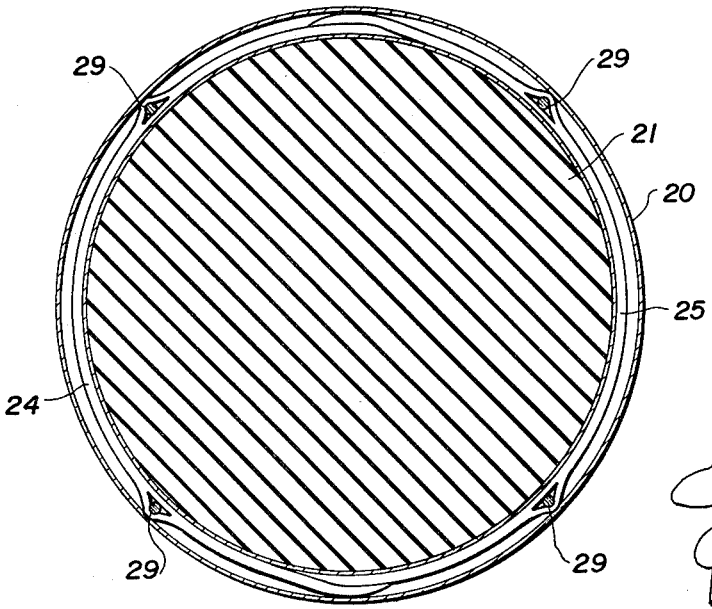
FIG. 3 is a horizontal section taken on line 3—3 of FIG. 2.

Referring to the drawings in detail, wherein like numerals designate like parts, a bowling ball sling in accordance with the invention comprises a flexible endless body portion, 20 in the nature of a band or belt which can assume an annular form when applied to a bowling ball 21. While dimensions are not critical, the body portion or band 20 is preferably about three inches wide to assure adequate supportive engagement with the ball without slippage thereon. The band 20 may be formed of fabric, leather or the like. It is preferably in the form of a flattened sleeve in cross section, FIG. 10, having a line of stitching 22 through both side walls of the sleeve at approximately one-third of the distance up from the bottom edge of the sleeve to produce a continuous circumferential chamber 23 within the band 20 for flexible adjustable finger grip loop extensions 24 and 25 shown schematically in FIGS. 6 and 7 and to be further described herein.

Finger grip loops 26 are formed integrally with the extensions 24 and 25 and these loops and extensions may be embodied in flexible cord or ropes of any preferred type, natural or synthetic. The branches of the loops 26 extend slidably through openings 27 provided in the opposite side walls of the body portion or band 20 in equidistantly spaced relationship around the circumference of the band. This arrangement distributes the weight of the bowling ball evenly around the circumference of the sling, such weight being borne primarily by the adjustable girth extensions 24 and 25.

Figure 2:
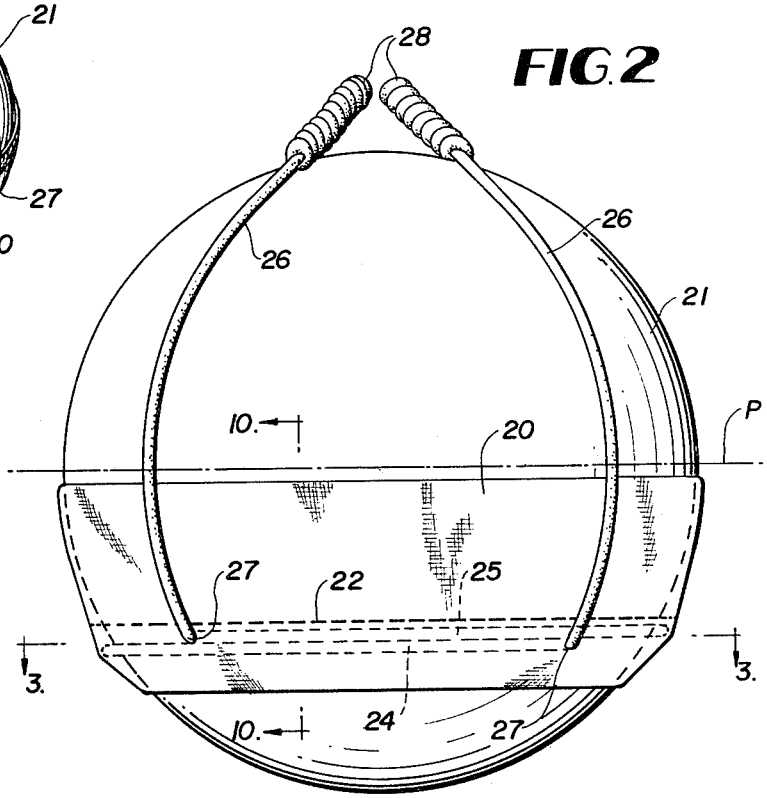
FIG. 2 is a side elevation showing the sling in the proper use position on a bowling ball.

As shown in FIGS. 2 and 9, optional braiding 28 can be provided on the finger grip loops 26 for increased comfort and good appearance.

Referring to FIGS. 6 and 7 which are schematic only to illustrate the diameter or girth adjustment of the band 20, it will be noted that the branches of the two finger grip loops 26 which are the extensions 24 and 25 extend slidably through guide openings 29 provided in the respective loops. Stop enlargements 30 are fused or otherwise formed on the respective extensions 24 and 25 of the finger grip loops to limit the adjustability of the body portion or band 20, the enlargements being unable to pass through the slide openings 29 when the loops 26 are pulled in opposite directions between the two positions of FIGS. 6 and 7 to constrict the band 20 into snug fitting engagement with the bowling ball. To expand the band 20, the same is merely stretched diametrically by the two hands of the user. The stretch limit of the material forming the band will limit the expansion of the band circumferentially, while the stop elements 30 limit its contraction. The adjustment means is very simple, economical and foolproof. The entire structure of the sling is flexible, strong and lightweight and no mechanical or rigid components are employed. This promotes safety and economy. The entire sling can be folded up and placed in one's trouser pocket, if desired. The band 20 can bear printed indicia on its outer face, such as a trademark and/or name of a particular bowling alley.

It is contemplated to make a standard model of the invention wherein the band 20 of the sling is fabric. In a deluxe model, the band will be soft leather.

In use, with the bowling ball at rest in the usual return gutter, the flexible band 20 is stretched by hand to its largest size as controlled by the stretch limits of the band per se. As shown in FIG. 6, the stop elements 30 do not control the expansion of the band 20 but only the contraction thereof, as in FIG. 7. The expanded band is placed downwardly over the bowling ball until its upper edge is below the plane P of maximum ball diameter, FIG. 2. When so positioned, the loops 26 are pulled in opposite directions outwardly to constrict or tighten the band 20 around the lower portion of the ball 21. The band then conforms snugly to the ball and forms a spherically curved pocket or seat for lifting the ball.

Figure 1:
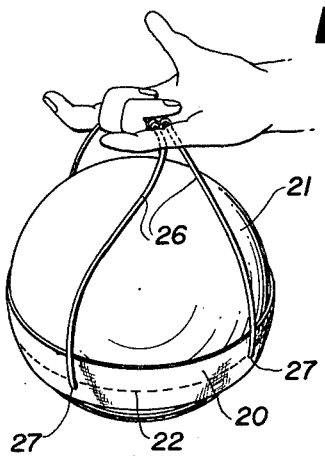
FIG. 1 is a perspective view of a bowling ball sling in accordance with the invention.
Figure 4:
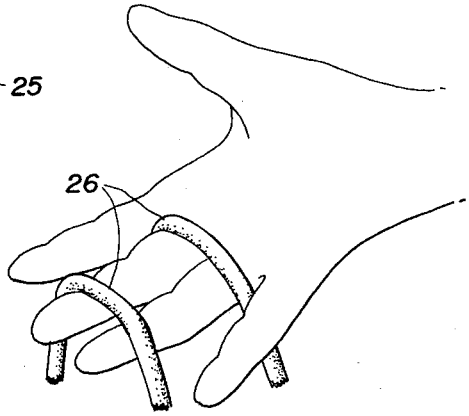
FIG. 4 is a perspective view showing the proper method of engaging the finger grip loops of the sling.

The finger grip loops 26 are then arranged over the top of the ball, FIGS. 1 and 2, and are engaged by the middle and ring fingers of the hand, FIG. 4, with the rear loop at the base of the fingers and the front loop at the first finger joints. The loops 26 are locked to the fingers simply by closing the fingers as shown in FIG. 5.

The bowler proceeds to bowl as usual. The bowling ball 21 is now suspended in the sling and is swung by the arm of the bowler in an arc longitudinally of the alley. At the forward end of the swing, the bowler merely relaxes his fingers at the first joint and the force of the ball will cause its release from the sling, as shown in FIG. 8. The rear finger grip loop 26 remains held by the bowler while the forward loop 26 is released by the relaxing or straightening of the fingers.

After some practice with the device, adjustments in the delivery of the bowling ball can be made just as adjustments are made where the bowler's fingers are engaged in openings in the ball, and the ball can be accurately directed to the "pocket" or "split", etc.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A lifting and propelling sling for bowling balls comprising a flexible band body portion which is endless and adapted to completely surround a bowling ball snugly in a region below the maximum diameter plane of the ball, and a pair of flexible finger grip loops connected with the band body portion and adapted to extend above the band body portion and somewhat above the bowling ball and being engageable above the ball by fingers of a bowler using the sling to bowl.

2. A lifting and propelling sling for bowling balls as defined in claim 1, and the finger grip loops including relatively movable extensions slidably engaged with the band body portion and operable to constrict the girth of the band body portion after the body portion is operatively positioned on a bowling ball responsive to pulling the finger grip loops outwardly in opposite directions relative to the ball.

3. A lifting and propelling sling for bowling balls as defined in claim 2, and said extensions of the finger grip loops being movably engaged, and coacting stops on the extensions to limit opposite movement of the extensions and to limit the degree of constriction of the band body portion.

4. A lifting and propelling sling for bowling balls as defined in claim 3, and said movable engagement of said extensions comprising guide openings in the extensions of one loop receiving therethrough slidably the extensions of the other loop, and said stops comprising enlargements on the extensions of both loops disposed inwardly of and between the guide openings of the two loops and being of sizes too large to pass through the guide openings when the two loops are pulled outwardly in opposite directions.

5. A lifting and propelling sling for bowling balls as defined in claim 2, and the band body portion including a continuous tubular chamber for said extensions and circumferentially spaced openings for said extensions leading to the exterior of the band body portion.

6. A lifting and propelling sling for bowling balls as defined in claim 5, and said circumferentially spaced openings being substantially equidistantly spaced on the body portion to distribute the bowling ball weight evenly in said sling.

7. A lifting and propelling sling for bowling balls as defined in claim 5, and said band body portion comprising a flattened endless sleeve in cross section, and an endless circumferential line of stitching through the walls of said sleeve forming said chamber at the bottom of said sleeve with relation to the use position of the sleeve.

8. A lifting and propelling sling for bowling balls as defined in claim 7, and the band body portion being formed entirely of fabric and said finger grip loops being formed of rope.

9. An entirely flexible sling for a bowling ball comprising an expandable and contractable flexible band body portion of endless construction adapted to assume an annular form around a bowling ball snugly and in conformance to the spherical surface of the ball in a region of the ball below its maximum diameter plane, and a pair of equal length identically formed flexible finger grip loops attached to the band body portion at opposite side portions thereof and adapted to be extended upwardly and over the top of the ball for lifting and propelling the ball in a bowling mode, and the width of the band body portion being substantially less than the radius of a bowling ball of conventional size.

* * * * *